US006424089B1

(12) United States Patent
Binder et al.

(10) Patent No.: US 6,424,089 B1
(45) Date of Patent: Jul. 23, 2002

(54) ELECTRIC INCANDESCENT LAMP WITH INFRARED REFLECTING LAYER

(75) Inventors: Ulrich Binder, Munich; Sigbert Mueller, Neusaess; Axel Bunk, Munich, all of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/554,880

(22) PCT Filed: Sep. 13, 1999

(86) PCT No.: PCT/DE99/02897

§ 371 (c)(1),
(2), (4) Date: May 22, 2000

(87) PCT Pub. No.: WO00/19489

PCT Pub. Date: Apr. 6, 2000

(30) Foreign Application Priority Data

Sep. 28, 1998 (DE) ..... 198 44 519

(51) Int. Cl.[7] ..... H01J 61/30; H01K 1/32
(52) U.S. Cl. ..... 313/634; 313/113; 313/635
(58) Field of Search ..... 313/113, 635, 313/634, 623, 624, 573, 574, 621, 569, 579, 578

(56) References Cited

U.S. PATENT DOCUMENTS

| | | | | |
|---|---|---|---|---|
| 4,375,605 A | | 3/1983 | Fontana et al. | |
| 4,756,701 A | | 7/1988 | Danko et al. | |
| 5,719,468 A | * | 2/1998 | Takanishi et al. | 313/112 |
| 5,811,934 A | | 9/1998 | Bunk et al. | |
| 6,111,344 A | * | 8/2000 | Binder et al. | 313/113 |
| 6,160,341 A | * | 12/2000 | Binder et al. | 313/110 |

FOREIGN PATENT DOCUMENTS

| | | |
|---|---|---|
| DE | 197 01 792 | 7/1998 |
| DE | 197 01 794 | 7/1998 |
| EP | 0 470 496 | 2/1992 |
| GB | 2082383 | 3/1982 |
| GB | 2144579 | 6/1985 |

* cited by examiner

*Primary Examiner*—Nimeshkumar D. Patel
*Assistant Examiner*—Karabi Guharay
(74) *Attorney, Agent, or Firm*—William E. Meyer

(57) ABSTRACT

Electrical incandescent lamp, in particular a halogen incandescent lamp (4) having a lamp bulb (5) which has a coating (9) that reflects IR radiation, and having a flat luminous body (10) which defines a fictional plane of the light and is arranged inside the lamp bulb (5). The shape of the lamp bulb (5) with respect to those axes which lie in the plane of the light have no rotational symmetry, but the lamp bulb (5) in fact has a shape which differs from rotational symmetry but is matched to the flat geometry of the luminous body (10), that is to say a flattened shape, in particular the shape of an ellipsoid, whose shortest half-axis is oriented at right-angles to the fictional plane of the light of the luminous body (10).

9 Claims, 3 Drawing Sheets

ELECTRIC INCANDESCENT LAMP WITH INFRARED REFLECTING LAYER

TECHNICAL FIELD

The invention is based on an electrical incandescent lamp, in particular a halogen incandescent lamp, having an IR-reflective coating, as claimed in the preamble of claim 1.

In particular, the invention relates to an incandescent lamp having a flat luminous body, for example a so-called flat-core filament. Unlike the incandescent filaments in incandescent lamps for general illumination, the cross section of flat-core filaments does not have a circular cross section but, in fact, an elongated cross section. The reason for this is to match the geometry of the filament shape to that emission characteristic of the lamp or of the incandescent filament that is preferred for the respective main application. In contrast to the rotationally symmetrical emission characteristic of conventional incandescent lamps, the flat luminous body of the lamp types mentioned initially allows particularly flat emission as is desirable, inter alia, for technical/scientific illumination purposes and in photographic optics, in particular for projection purposes. Typical electrical power levels are in the range from about 50 to 400 watts.

The coating which reflects IR radiation and is applied to the inner and/or outer surface of the lamp bulb—referred to for short as the IR coating in the following text—results in a large proportion of the IR radiation power emitted from the luminous body being reflected back to it. The improvement in the lamp efficiency achieved in this way can be used firstly to increase the temperature of the luminous body, and in consequence to increase the light flux, with a constant electrical power consumption. Secondly, a predetermined light flux can be achieved with a reduced electrical power consumption—an advantageous "power saving effect". A further desirable effect is that the IR coating results in considerably less IR radiation power being emitted through the lamp bulb, and thus in the environment, for example an optical projection apparatus, being heated less than by conventional incandescent lamps.

Owing to the unavoidable absorption losses in the IR coating, the power density of the IR radiation elements within the lamp bulb decreases with the number of reflections and, in consequence, the efficiency of the incandescent lamp also decreases. The critical factor for the efficiency increase which can actually be achieved is therefore to minimize the number of reflections required to return the individual IR beams to the luminous body. To this end, the shape of the lamp bulb that is provided with the IR coating is specifically matched to the shape of the luminous body.

PRIOR ART

EP-A 0 470 496 discloses a lamp having a spherical bulb, in whose center a cylindrical luminous body is arranged. This document teaches that the reductions in efficiency due to the difference between the luminous body and the ideal spherical shape can be limited to an acceptable level, subject to the following preconditions. Either the bulb diameter and the luminous body diameter or length must be carefully matched to one another within a tolerance band, or else the diameter of the luminous body must be considerably less (the factor by which it is less being 0.05) than that of the lamp bulb. Furthermore, a lamp having a rotationally ellipsoid bulb is cited in whose focal line an elongated luminous body is arranged axially.

DESCRIPTION OF THE INVENTION

The invention is based on the object of specifying an incandescent lamp having a flat luminous body, which incandescent lamp is distinguished by the emitted IR radiation being returned efficiently to the luminous body, and in consequence being distinguished by high efficiency. A further aspect is the distribution of the return IR radiation on the luminous body. Furthermore, the aim is to achieve compact lamp dimensions with high light densities, as is particularly desirable for low-voltage halogen incandescent lamps.

This object is achieved according to the invention by the descriptive features of claim 1. Particularly advantageous refinements can be found in the dependent claims.

The invention proposes that the lamp bulb be deliberately shaped such that the lamp bulb has no rotational symmetry with respect to the axes lying in the plane of the light of the flat luminous body, but the lamp bulb in fact has a shape which differs from rotational symmetry but is matched to the flat geometry of the luminous body, that is to say a flattened shape. If required, the shape of the base area of the flat luminous body can also be matched to the area of the luminous body that is actually illuminated by the reflected IR radiation.

In particular, the invention proposes that the shape of the lamp bulb corresponds essentially to an ellipsoid having three half-axes, at least two of which are of different lengths, and with the luminous body being arranged inside the lamp bulb in such a manner that the shortest of the three half-axes of this ellipsoid is oriented at right-angles to the plane of the light of the luminous body. In this way, the lamp bulb has the desired flat shape, when viewed in the direction of the plane of the light.

The following text refers to FIGS. 1*a*–1*c* in order to explain the idea of the invention further. These Figures show a schematic illustration of the fundamental relationships, and introduce a number of parameters which are essential for further understanding of the invention.

The Figures show, inter alia, three sections through an ellipsoid 1 having the three half-axes a, b and c. The sections correspond to the viewing directions in the three Cartesian spatial axes x, y and z, which are also chosen to be collinear with the three half-axes a, b and c, respectively. The half-axis c is shorter than the other two half-axes a and b. A stylized flat luminous body 2 having two mutually parallel rectangular base areas 3 and 3' is arranged centered inside the ellipsoid 1. These two base areas 3 and 3' correspond in the case of a real flat luminous body to those two luminous areas which essentially produce the light flux of the lamp.

For simplicity, the following text refers to a fictional plane of the light, which is defined as running parallel and centrally between the two base areas 3, 3'.

The luminous body 2 is now oriented inside the ellipsoid 1 in such a manner that its fictional plane of the light is at right-angles to the half-axis c. The half-axes a and b thus run in the plane of the light and, in consequence, parallel to the base areas 3, 3' of the luminous body 2.

The specific values for the three half-axes can be deliberately individually matched to the shape and dimensions of the luminous body in such a way as to ensure that the emitted IR radiation is returned as efficiently as possible to the luminous body. In order to achieve a long lamp life, the weighting of the matching criteria for the three half-axes may also be shifted more in the direction of the returned IR radiation being distributed as uniformly as possible on the luminous body. In particular, local IR radiation power maxima, so-called "hot spots", generally have a detrimental effect on a long life of the luminous body, and should therefore be avoided.

The uniformity of the distribution can also be improved by deliberately matching the external shape of the luminous body to the shape of the returned radiation spot on the luminous body. For example, it has been found that the returned radiation spot is essentially oval when the maximum amount of emitted IR radiation is returned. For this reason, it may be advantageous to chose an oval shape for the luminous body as well and, furthermore, largely to match its external dimensions to those of the returned radiation spot.

In the case of rotationally symmetrical luminous bodies, that is to say luminous bodies having a circular base area, and in the case of luminous bodies which may be regarded, at least to a rough approximation, as being circular for example luminous bodies having a square base area, it may be advantageous to chose the half-axes a and b of the ellipsoid to be of equal lengths.

The deliberate matching of the three ellipse half-axes to the luminous body can be assisted using so-called ray-tracing methods. In this case, light beams that originate from the flat-core filament are traced, and the ellipse half-axes are determined, in such a way as to achieve maximum efficiency for returned radiation, or else optimum uniformity of the distribution of the returned light beams on the filament, or some compromise of this nature.

DESCRIPTION OF THE DRAWINGS

The invention will be explained in more detail in the following text with reference to an exemplary embodiment. In the Figures:

FIG. 2 is an exemplary embodiment of a lamp 4 according to the invention, schematically. This figure shows a halogen incandescent lamp with a rated voltage of 24 V and a rating of 250 W, and a version for 150 W. The value details below relate to both power types, unless stated to the contrary. Where the values for the two types differ, the value for the 250 W lamp type is stated first, followed by the corresponding value for the 150 W lamp type, enclosed in brackets.

Figure 1A:
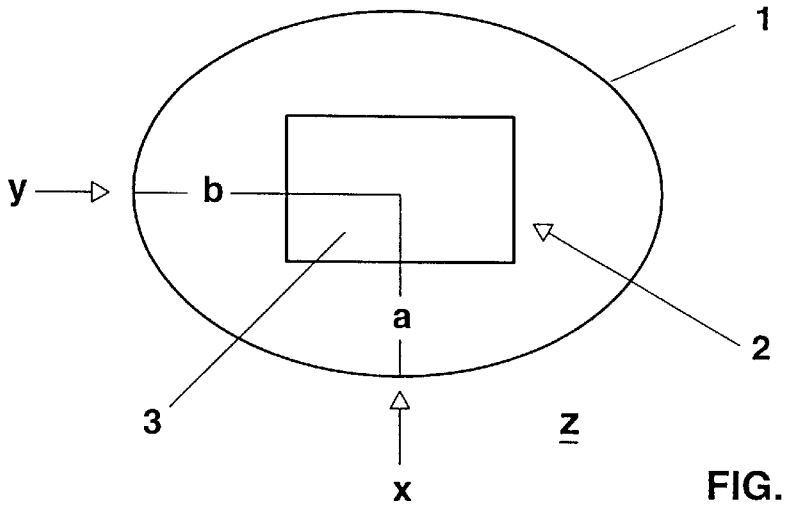
FIG. 1*a* shows a schematic illustration of the principle of the invention, based on an ellipsoid and a rectangular, flat luminous body, viewed in the z-direction.
Figure 1B:
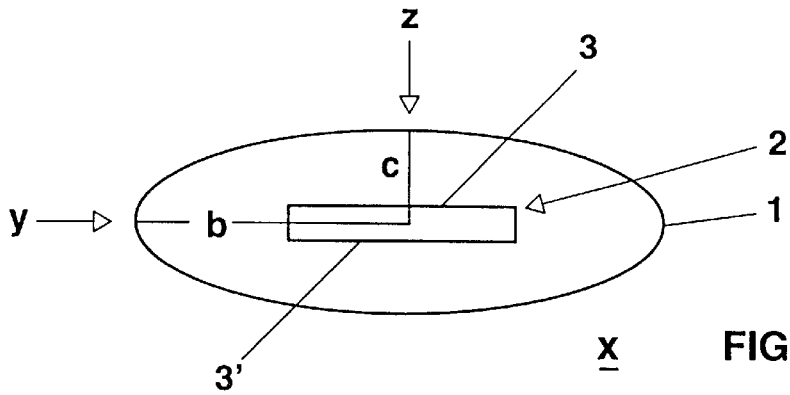
FIG. 1*b* shows a schematic illustration of the ellipsoid, with the luminous body from FIG. 1*a*, viewed in the x-direction.
Figure 1C:
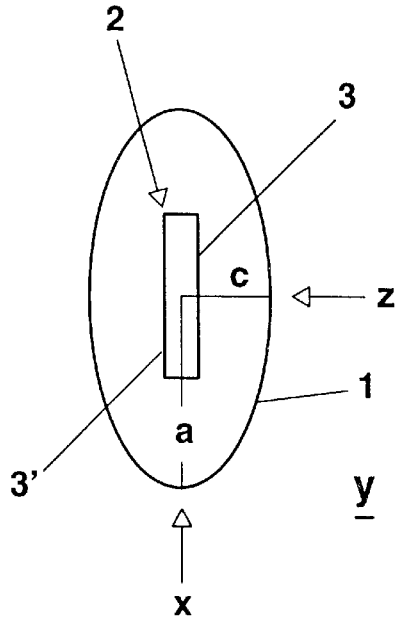
FIG. 1*c* is as FIG. 1*b*, but viewed in the y-direction.

The lamp has a lamp bulb 5 pinched at one end, which merges at its first end into a neck 6 which ends in a pinch seal 7. At its opposite end, the lamp bulb 5 has a pump tip 8. The position of the pump tip 8 and of the pinch seal 7 define a longitudinal axis LA of the lamp 4.

An IR coating 9, comprising an interference filter with more than 20 layers of $TiO_2$ and $SiO_2$ is applied to the outer surface of the lamp bulb 5. $Ta_2O_5$ is also suitable instead of $TiO_2$. The IR coating also covers approximately half of the pinch seal 7 as well. This firstly ensures that the IR coating 9 has a shape with particularly well-defined dimensions since, during production of the lamp bulb 5, its outer surface is given the calculated contour of the ellipsoid. Secondly, the fact that the IR coating 9 extends onto a part of the pinch seal 7 results in the individual layers being particularly uniform in the region of the bulb surface. This reduces color errors.

The length of the lamp neck 6 is approximately 2 mm, with a maximum width of approximately 9.6 mm. The lamp bulb 5 is manufactured from quartz glass, with a wall thickness of approximately 1 mm.

With the exception of the pinch seal 7 and the pump tip 8, the lamp bulb 5 has an ellipsoid shape. The respective length of the three half-axes a, b and c of this ellipsoid are 8.4 mm, 9 mm and 8 mm (8.2 mm, 8.5 mm and 8 mm), respectively, for maximum efficiency and 9 mm, 9.6 mm and 8 mm for optimum uniformity of the radiation returned in the 250 W lamp type.

A luminous body 10 is arranged centrally inside the lamp bulb 5. The luminous body 10 consists of a single flat-core element (illustrated only schematically here, but see FIGS. 3*a* and 3*b*). The filament axis is oriented at right-angles to the longitudinal axis LA of the lamp 9, and runs in the plane covered by the half-axes a and b of the ellipsoid. For further details relating to the flat-core filament 10, reference should be made to FIGS. 3*a* and 3*b*, and the associated figure descriptions.

The electricity supply leads 11*a, b* are formed directly by the filament wire, and are connected to molybdenum foils 12*a, b* in the pinch seal 7. The molybdenum foils 12*a, b* are for their part connected to external cap pins 13*a, b*.

The lamp bulb 5 is filled internally with a xenon (Xe) and nitrogen (N) mixture at a pressure of approximately 3990 hPa and in the ratio Xe:N=88:12 with 0.7% (0.4%) hydrogen bromide (HBr) as an additive.

The lamp 4 has a color temperature of approximately 3400 K. The light flux is 12230 lm (6750 lm) for a power consumption of 265 W (158 W), corresponding to a light yield of approximately 46 lm/W (42.7 lm/W). A comparable, conventional lamp achieves a light flux of only 9150 lm (5050 lm) for the same electrical power consumption, corresponding to a light yield of approximately 34.4 lm/W (32 lm/W). In consequence, an increase in efficiency of up to 34% (33.7%) can be achieved when this is compared with the lamp according to the invention.

Figure 2:
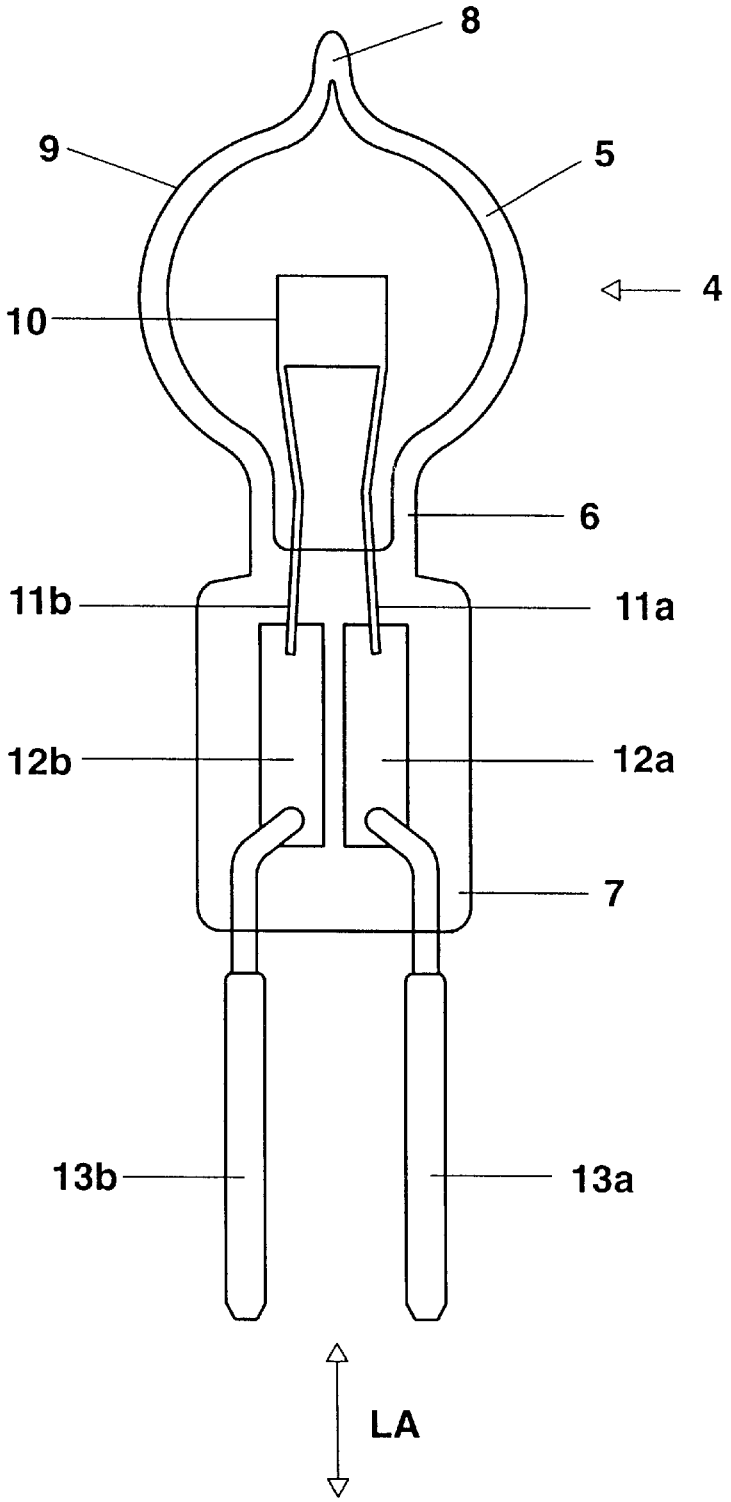
FIG. 2 shows a low-voltage halogen incandescent lamp having an IR coating and a flat-core filament, as well as a bulb shape according to the invention.
Figure 3A:
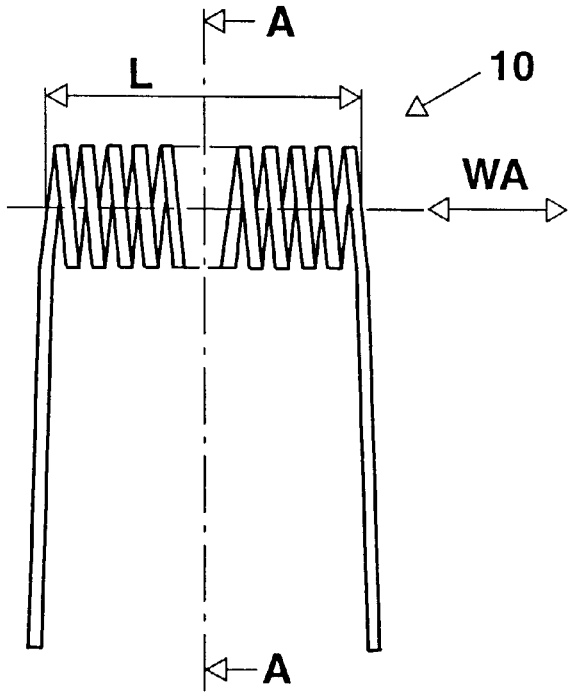
FIG. 3*a* shows a schematic illustration of a side view of the flat-core filament from FIG. 2.
Figure 3B:
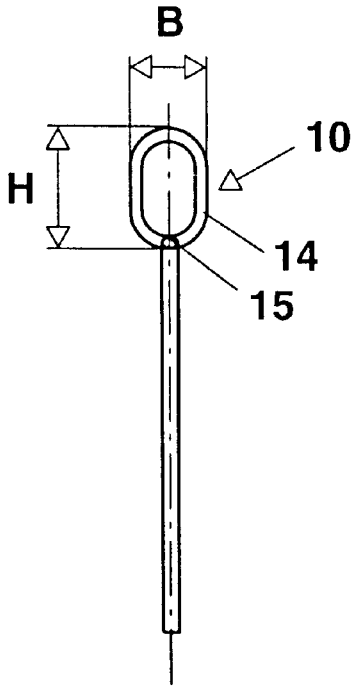
FIG. 3*b* shows a section illustration of the flat-core filament from FIG. 3*a*, along the line AA.

FIGS. 3*a* and 3*b* show the flat-core filament 10 from FIG. 2 in a side view, and in a section along the line AA, respectively. The flat-core filament 10 is wound from tungsten wire with a diameter of approximately 292 $\mu$m, and with a total of 17 turns (20 turns). The length L of the filament 10 in the direction of the filament axis WA is approximately 7.4 mm (6.9 mm). The height H and width B are approximately 4 mm (3.26 mm) and 1.4 mm (1.15 mm), respectively. The section view in FIG. 3*b* shows a turn 14, which is essentially in the form of an elongated oval in the plane of the section, of the flat-core filament 10 and the notch 15.

In one version (not illustrated), the flat-core filament of the lamp shown in FIG. 2 is shaped in such a manner that the side view of the flat-core filament has an oval contour, matched to the shape of the IR returned radiation spot. To this end, the respective height H of the individual turns is small at a first end of the filament, then increases in the center of the filament to its maximum height (in the example of the lamp in FIG. 2, to approximately 4 mm for the 250 W type), and then decreases again towards the other end of the filament.

The following Tables 1, 2 and 3 are based on the ray-tracing program to indicate ellipse half-axes a, b, c which have been found to be suitable for three power types, namely 150 W, 250 W and 400 W. In this case, the ellipse half-axis c was in each case given, and the two other ellipse half-axes a, b were determined. Depending on the application, the maximum value for the half-axis c is in practice often specified, for example, by the intended installation depth in projectors. The wall thickness was assumed to be constant, at 0.8 mm. The dimensions intended for the flat-core filament of the respective power type in the plane covered by the ellipse half-axes a, b are also stated.

TABLE 1

| Ellipse half-axes in mm | | | | |
|---|---|---|---|---|
| a | b | c | c/a | c/b |
| 6.3 | 6.9 | 6 | 0.95 | 0.87 |
| 7.2 | 7.7 | 7 | 0.97 | 0.91 |
| 8.2 | 8.5 | 8.0 | 0.98 | 0.94 |
| 9.2 | 9.5 | 9 | 0.98 | 0.95 |
| 10.1 | 10.5 | 10 | 0.99 | 0.95 |
| 11.1 | 11.4 | 11 | 0.99 | 0.96 |

Power: 150 W
Filament dimensions: 2.975 × 5.65 $mm^2$

TABLE 2

| Ellipse half-axes in mm | | | | |
|---|---|---|---|---|
| a | b | c | c/a | c/b |
| 6.4 | 7.2 | 6 | 0.94 | 0.83 |
| 7.4 | 8.1 | 7 | 0.95 | 0.86 |
| 8.3 | 9.0 | 8.0 | 0.96 | 0.89 |
| 9.3 | 9.8 | 9 | 0.97 | 0.92 |
| 10.3 | 10.7 | 10 | 0.97 | 0.93 |
| 11.2 | 11.8 | 11 | 0.98 | 0.93 |

Power: 250 W
Filament dimensions: 3.63 × 7.1 $mm^2$

TABLE 3

| Ellipse half-axes in mm | | | | |
|---|---|---|---|---|
| a | b | c | c/a | c/b |
| 7.6 | 8.8 | 7 | 0.92 | 0.80 |
| 8.4 | 9.6 | 8 | 0.95 | 0.83 |
| 9.4 | 10.6 | 9 | 0.96 | 0.85 |
| 10.4 | 11.2 | 10 | 0.96 | 0.89 |
| 11.3 | 12.1 | 11 | 0.97 | 0.91 |
| 12.3 | 13.2 | 12 | 0.98 | 0.91 |

Power: 400 W
Filament dimensions: 4.61 × 9.74 $mm^2$

The following relationships for the three half-axes a, b, c have been found to be advantageous for an ellipsoid which essentially forms the shape of the lamp bulb, based on the results shown in the above tables and the present state of knowledge with regard to bulb shapes that are as compact as possible, and with regard to matching capabilities to achieve maximum efficiency or optimum uniformity:

$0.9 \leqq c/a \leqq 0.99$, in particular $0.95 \leqq c/a \leqq 0.98$ and $0.8 \leqq c/b \leqq 0.97$, in particular $0.85 \leqq c/b \leqq 0.95$, with the two half-axes a, b being in the plane of the flat-core filament, and the half-axis c being at right-angles to the plane of the light from the flat-core filament.

What is claimed is:

1. An electrical incandescent lamp, in particular a halogen incandescent lamp (4) having a lamp bulb (5) which has a coating (9) that reflects IR radiation, and having a flat luminous body (10) which defines a fictional plane of the light, is arranged inside the lamp bulb (5) and is held by means of two electricity supply leads **(11*a*, 11*b*), with the two electricity supply leads (11*a*, 11*b*) being routed to the exterior in a gastight manner, wherein the shape of the lamp bulb (5) with respect to those axes which lie in the plane of the light have no rotational symmetry, but wherein the lamp bulb (5) in fact has a shape which differs from rotational symmetry but is matched to the flat geometry of the luminous body (10)**, that is to say a flattened shape.

2. The incandescent lamp as claimed in claim 1, with the shape of the lamp bulb (5) essentially corresponding to an ellipsoid (1) having three half-axes (a, b, c), at least two of which are of different lengths, and with the luminous body (2; 10) being arranged inside the lamp bulb (5) in such a manner that the shortest (c) of the three half-axes of this ellipsoid (1) is oriented at right-angles to the fictional plane of the light of the luminous body (2; 10).

3. The incandescent lamp as claimed in claim 1 with the following value range applying to the relationships of the half-axes a, c:

$0.9 \leqq c/a \leqq 0.99$, in particular $0.95 \leqq c/a \leqq 0.98$.

4. The incandescent lamp as claimed in claim 1 with the following value range applying to the relationships of the half-axes b, c:

$0.8 \leqq c/b \leqq 0.97$, in particular $0.85 \leqq c/b \leqq 0.95$.

5. The incandescent lamp as claimed in claim 1 with the luminous body (10) being a flat-core filament.

6. The incandescent lamp as claimed in claim 1 with the outline of the luminous body (10) having a rectangular shape parallel to the fictional plane of the light.

7. The incandescent lamp as claimed in claim 1 with the outline of the luminous body having an oval shape parallel to the fictional plane of the light.

8. The incandescent lamp as claimed in claim 1 with the outline of the luminous body having a circular shape, or at least a roughly approximately circular shape, parallel to the fictional plane of the light, in particular also the shape of a square or a regular polygon.

9. The incandescent lamp as claimed in claim 1 wherein the lamp bulb (5) has a lamp neck (6) at at least one end, which lamp neck (6) surrounds at least one electricity supply lead **(11*a*, 11*b*) as closely as possible, and whose end (8)** remote from the bulb is closed in a gastight manner.

* * * * *